US010214409B2

(12) United States Patent
You et al.

(10) Patent No.: US 10,214,409 B2
(45) Date of Patent: Feb. 26, 2019

(54) REFRIGERATOR

(71) Applicant: LG ELECTRONICS INC., Seoul (KR)

(72) Inventors: Jimin You, Seoul (KR); Changyoon Jung, Seoul (KR); Siyeon An, Seoul (KR); Yonghyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 238 days.

(21) Appl. No.: 14/607,225

(22) Filed: Jan. 28, 2015

(65) Prior Publication Data

US 2015/0225226 A1 Aug. 13, 2015

(30) Foreign Application Priority Data

Feb. 12, 2014 (KR) ..... 10-2014-0015798

(51) Int. Cl.

*B67D 1/08* (2006.01)
*B67D 1/00* (2006.01)
*F25D 23/12* (2006.01)

(52) U.S. Cl.

CPC ..... *B67D 1/0895* (2013.01); *B67D 1/0014* (2013.01); *B67D 1/0884* (2013.01); *F25D 23/126* (2013.01); *F25D 2400/02* (2013.01)

(58) Field of Classification Search

CPC .. B67D 1/0014; B67D 1/0884; B67D 1/0895; B67D 1/0095; F25D 23/126; F25D 31/005; F25D 2400/02; F24H 1/10; H05B 1/02; H05B 1/0244

USPC ..... 219/490, 494; 392/466, 480, 486; 62/389–400; 222/54–55, 59, 71–73, 222/146.1–146.6

See application file for complete search history.

(56) References Cited

U.S. PATENT DOCUMENTS 6,613,236 B1 * 9/2003 Guess ..... B01D 35/143 210/739
6,869,538 B2 * 3/2005 Yu ..... A61M 1/28 210/143
7,207,189 B2 * 4/2007 An ..... B01D 35/18 165/63
2007/0251261 A1 * 11/2007 Son ..... F25D 23/063 62/390
2009/0159611 A1 * 6/2009 Roetker ..... B67D 1/0858 222/1

(Continued)

FOREIGN PATENT DOCUMENTS

CN 1536305 10/2004
CN 1548888 11/2004

(Continued)

OTHER PUBLICATIONS

Chinese Office Action dated Sep. 20, 2016 issued in Application No. 201410741208.9 (with English translation).

*Primary Examiner* — Paul R Durand
*Assistant Examiner* — Andrew P Bainbridge
(74) *Attorney, Agent, or Firm* — Ked & Associates, LLP

(57) ABSTRACT

A refrigerator includes a main body defining a storage space therein, a door that opens and closes the storage space, and a hot water module including an instantaneous heater for heating water. The hot water module measures a flow rate of water along with a temperature of water introduced to the instantaneous heater to ensure the proper amount and temperature of water is dispensed.

15 Claims, 6 Drawing Sheets

(56) References Cited

U.S. PATENT DOCUMENTS

| | | | | |
|---|---|---|---|---|
| 2009/0249821 | A1* | 10/2009 | Zentner | F24H 1/103 62/389 |
| 2013/0104586 | A1* | 5/2013 | Krause | B67D 1/07 62/275 |
| 2014/0230481 | A1* | 8/2014 | Yun | F25D 23/126 62/340 |
| 2014/0270724 | A1* | 9/2014 | Hall | B67D 7/82 392/341 |
| 2014/0270725 | A1* | 9/2014 | Bertolini | B67D 7/82 392/341 |
| 2015/0225226 | A1* | 8/2015 | You | B67D 1/0895 222/54 |

FOREIGN PATENT DOCUMENTS

| | | |
|---|---|---|
| CN | 101063573 | 10/2007 |
| CN | 101358801 | 2/2009 |
| CN | 101975500 | 2/2011 |
| CN | 102405386 | 4/2012 |
| CN | 102519209 | 6/2012 |
| CN | 103486812 | 1/2014 |
| WO | WO 2007/011173 | 1/2007 |
| WO | WO 2011/013953 | 2/2011 |

* cited by examiner

REFRIGERATOR

CROSS-REFERENCE TO RELATED APPLICATION

This application claims priority under 35 U.S.C. § 119 to Korean Application No. 10-2014-0015798 filed on Feb. 12, 2014, whose entire disclosure is hereby incorporated by reference.

BACKGROUND

1. Field

The present disclosure relates to a refrigerator.

2. Background

Refrigerators are home appliances for storing foods at a low temperature. Such a refrigerator has one or both of a refrigerating compartment storing foods in a refrigerated state and a freezing compartment storing foods in a frozen state. In recent years, a dispenser is mounted on a front surface of a refrigerator door to dispense drinking water without opening the refrigerator door. In addition, an ice maker for making and storing ice cubes may be provided in a door or a storage space of refrigerator. Thus, the ice cubes may be dispensed through the dispenser.

In the related art, there is a hot water supply system for a cold and hot water dispenser. For example, Korean Patent Publication No. 10-2012-0112060 discloses a device and method for supplying hot water. The related art discloses a method of controlling an instantaneous heating device applied to the hot water supply system of the cold and hot water dispenser. For example, a technology is disclosed for regulating an amount of inflow water according to a target water temperature, an inflow water temperature, and heating capacity of a heater.

According to the related art, a water flow sensor measures a flow rate of water passing through an inflow valve, and an opening degree or opening/closing of the inflow valve is controlled again by using the measured flow rate as feedback information. There is a high variation in flow rate measured by the water flow sensor, and an error in the water flow sensor itself is non-negligible. As a result, it is difficult to a water temperature desired by consumer in spite of precise control. In such a control method, there is a considerable variation in temperature of the first cup for hot water.

Due to this limitation, a heater is additionally feedback-controlled in the related art to attain a desired water temperature, and yet the desired water temperature is not attainable. In addition, a heating time of an instantaneous heating device has a constant value or depends upon an external input, and thus, it is difficult to control a water temperature as desired. Further, since the timing of water discharge is not determined, consumers may not obtain water with an accurate temperature. In the related art, hot water with an accurate temperature may not be supplied due to this limitation. In addition, it is not possible to secure safety in a heater.

BRIEF DESCRIPTION OF THE DRAWINGS

The embodiments will be described in detail with reference to the following drawings in which like reference numerals refer to like elements wherein.

DETAILED DESCRIPTION

Figure 1:
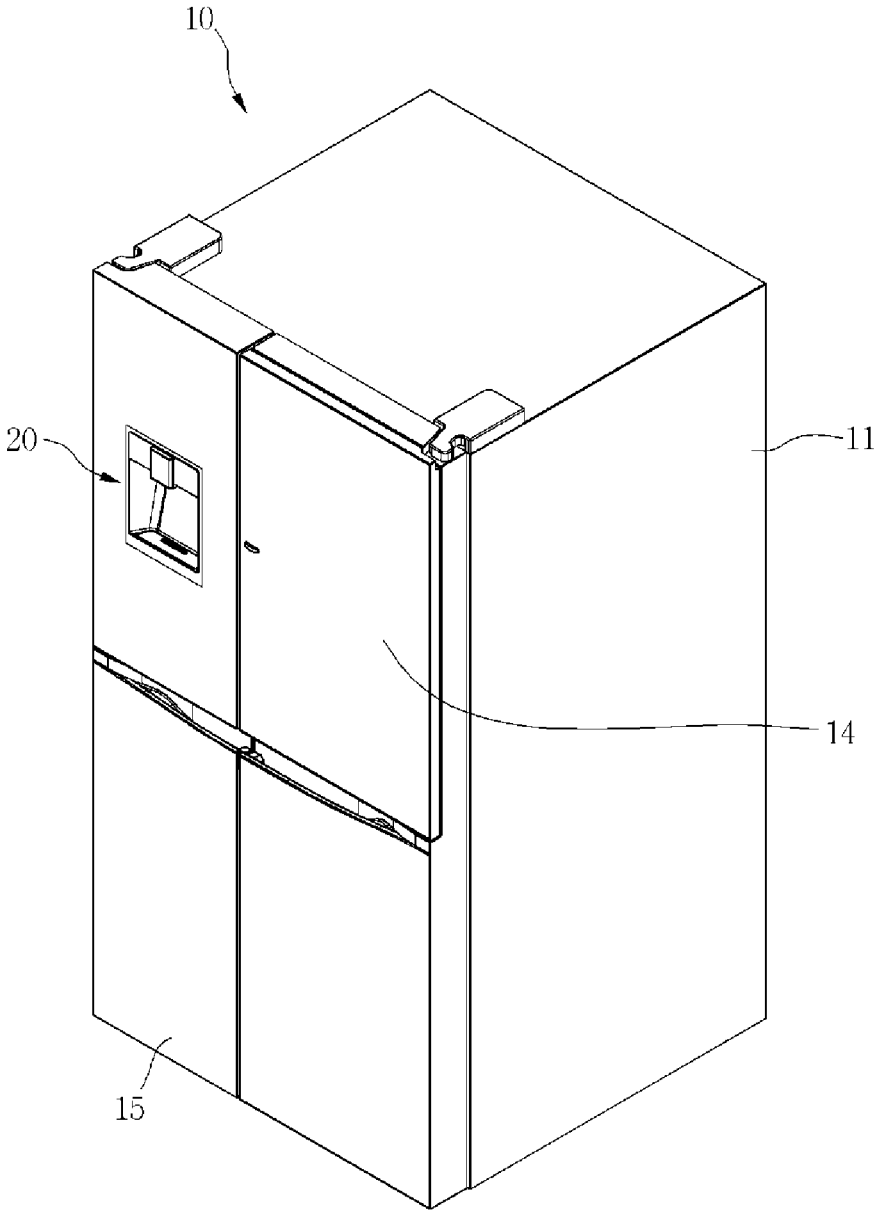
FIG. 1 is a perspective view of a refrigerator according to an embodiment.
Figure 2:
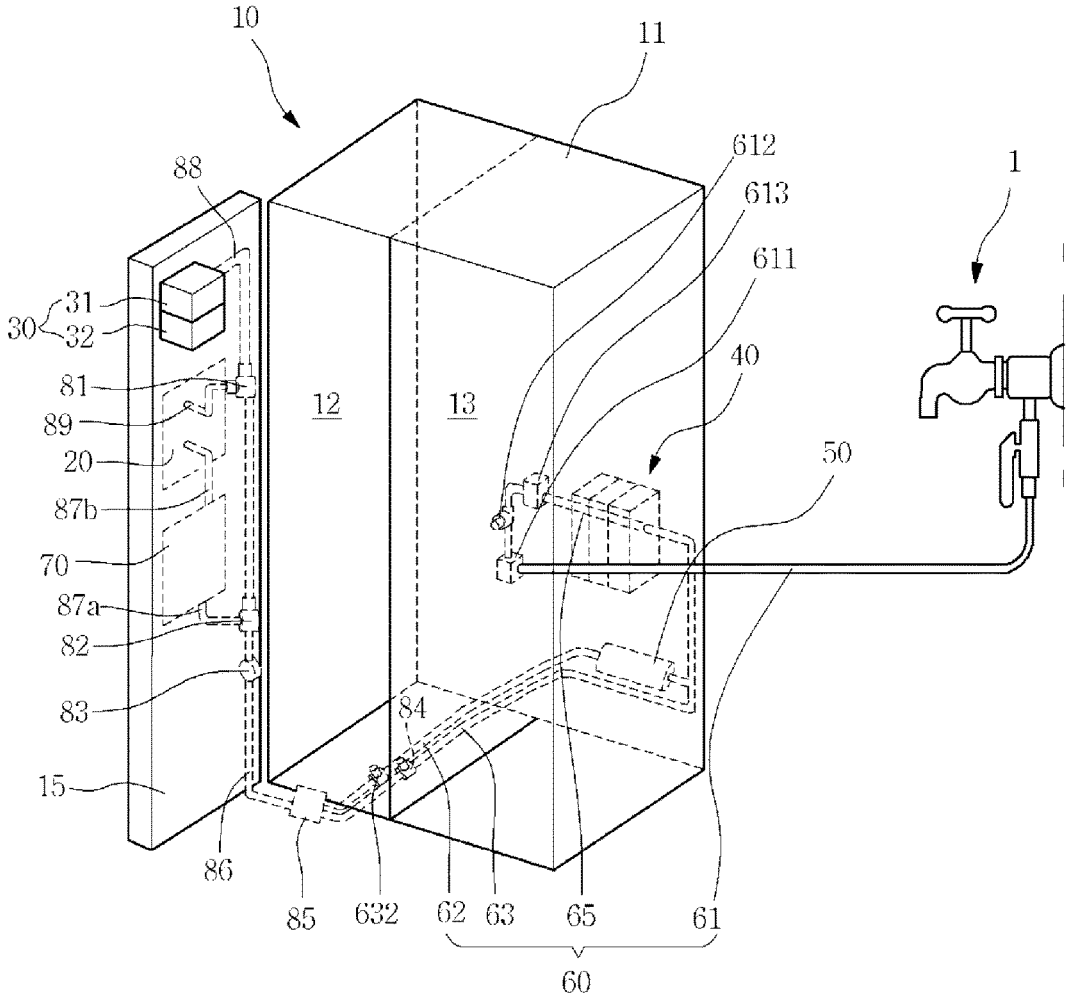
FIG. 2 is a schematic perspective view illustrating an arrangement of passages through which water flows in the refrigerator.

Referring to FIGS. 1 and 2, a refrigerator 10 according to an embodiment includes a main body 11 defining a storage space with an open front side and a door opening/closing the storage space. The storage space may vary with types and shapes of refrigerators. Although a freezing compartment 12 and a refrigerating compartment 13 are provided at left and right sides of a barrier, respectively, in the embodiment illustrated in FIG. 1, the current embodiment is not limited to the type of a refrigerator and the position and number of freezing and refrigerating compartments.

The door may include a refrigerating compartment door 14 and a freezing compartment door 15. Each of the refrigerating and freezing compartment doors 14 and 15 may be hingedly coupled to the main body 11 at upper and lower ends thereof to open/close the refrigerating and freezing compartments 13 and 12.

A dispenser 20 may be provided in a front surface of the freezing or refrigerating compartment door 15 or 14. For example, the dispenser 20 is provided in the freezing compartment door 15 in FIG. 1. The dispenser 20 is configured to dispense water or ice cubes to the outside without opening the freezing compartment door 15. The dispenser 20 may have a shape that is recessed form the front surface of the freezing compartment door 15.

An ice-making device 30 is provided in a back surface of the freezing compartment door 15. Alternatively, the ice-making device 30 may be provided in the refrigerating compartment door 14. In the following description, constitutions disposed in the freezing compartment door may be installed in the refrigerating compartment door in like manner and be referred to as a door in some cases. The ice-making device 30 may freeze supplied water to make and store ice cubes.

The ice-making device 30 may include an automatic ice maker 31 making ice cubes by using automatically supplied water to transfer the made ice cubes and an ice bank 32 disposed under the automatic ice maker 31 to store the ice cubes transferred from the automatic ice maker 31. Although not specifically illustrated in FIGS. 1 and 2, the ice bank 32 may communicate with the dispenser 20 through an ice chute to dispense the ice cubes within the ice bank 32 through the dispenser 20 when the dispenser is manipulated. In addition, the ice bank 32 may further include a constitution for allowing the stored ice cubes to be dispensed in a cubed or crushed state according to user's selection.

The main body 11 may be provided with a filter unit 40 that purifies water supplied from an external water supply source 1 and a water tank 50 that stores the purified water passing through the filter unit 40 and is cooled by cool air within the refrigerating compartment 13.

The refrigerator 10 may be connected to the external water supply source 1 to receive water. A water supply flow path 60 connected to the external water supply source 1, the filter unit 40, the water tank 50, the dispenser 20, and the ice-making device 30 to guide a water flow is disposed in the main body 11 and the freezing compartment door 15.

The water supply flow path 60 may include a water supply passage 61 connecting the water supply source 1 that is exemplified as a faucet outside the main body 11 to the filter unit 40 disposed in the main body 11, a purified water passage 62 through which the water purified in the filter unit 40 flows, and a cold water passage 63 guiding the water purified in the filter unit 40 toward the door through the water tank 50.

The refrigerator 10 may include a purified water valve 84 regulating water supply through the purified water passage 62 and a cold water valve 632 regulating water supply through the cold water passage 63. The purified water passage 62 and the cold water passage 63 may be combined into a single duct to extend toward the door via a door hinge 85. That is, at least one portion of the purified water passage 62 and the cold water passage 63 may share the same duct. When the refrigerator door is separated from the main body, the duct constituting the passage may also be separated by the door hinge 85.

The water supply passage 61 may extend from the water supply source 1 into the main body 11 and be connected to the filter unit 40. The water supply passage 61 may be constituted by two tubes with respect to the main body that are connected to each other by a fitting member 611. The fitting member 611 may be disposed on a rear surface of the main body 11 so that a user may selectively separate the tube of the water supply passage 61 connected to the water supply source 1. In addition, a cleaning device may be connected as needed to sterilize and clean the water tank 50 as well as the water supply flow path 60. A water supply valve 612 may be provided in the water supply passage 61. The water supply valve 612 opens or closes the water supply passage 61 to determine the water supply into the filter unit 40 and may be provided in one side of the main body 11. The water supply valve 612 may be integrated with the fitting member 611.

The filter unit 40 may be placed in the refrigerating compartment 13. In this case, the water supply passage 61 may extend up to the inside of the refrigerating compartment 13. The filter unit 40 may have a cleaning passage 65 therein. The water supply passage 61 may be connected to the cleaning passage 65 to purify the water supplied from the water supply source 1 while passing through the filter unit 40.

The water supply flow path 60 may further include a door passage disposed in the door. The door passage may further include a common passage 86, and a water supply passage 87*a* and ice-making passage 88 which are branched from the common passage 86. Cold water and purified water may flow into the common passage. The purified water flowing through the common passage 86 may be supplied to the ice-making passage 88. The purified water supplied through the purified water passage 62 may have a relatively high temperature to prevent the water from being frozen while flowing into the freezing compartment door 15, thereby stably supplying the water into the ice-making device 30.

The water purified in the filter unit 40 is supplied into the dispenser 20 through the cold water passage 63 after being cooled while passing through the water tank 50. The cold water passage 63 may be directly connected to the filter unit 40. Alternatively, the cold water passage 63 may be branched from the purified water passage 62 and then be connected to the water tank 50.

The door may be provided with a water flow sensor 83 capable of measuring a flow rate of water flowing through the common passage 88. A flow rate of water passing though the water flow sensor 83 may vary depending upon a water pressure of the water supply source 1. For example, when the water supply source 1 has a high water pressure, a large amount of water may be supplied to the water flow sensor 83, whereas when the water supply source 1 has a low water pressure, a small amount of water may be supplied to the water flow sensor 83. However, the determined water pressure may be usually maintained in any one region.

The water passing through the water flow sensor 83 flows into a first switching valve 82. The first switching valve 82 allows the supplied water to be divided into a hot water module 70 or a second switching valve 81. The second switching valve 81 guides the supplied water to the ice-making device 30 or the dispenser 20. The supply passage 87*a* may be connected to the first switching valve 82. A dispensing passage 89 may be connected to the second switching valve 81. In addition, a hot water discharging passage 87*b* may be connected to the hot water module 70.

Hot water, cold water, or purified water may be dispensed to the outside and supplied into the ice-making passage by switching the first and second switching valves 81 and 82. For example, when the purified water valve 84 is opened, and the first switching valve 82 is switched to allow the water to flow toward the hot water module 70, the purified water may be supplied to the hot water module 70, and the hot water may be dispensed from the hot water dispensing passage 87*b*.

When the purified water valve 84 is opened, the first switching valve 82 is switched to allow the water to flow toward the second switching valve 81, and the second switching valve 81 is switched to allow the water to flow toward the dispenser 20, the purified water may be dispensed from the dispensing passage 89.

When the purified water valve 84 is opened, the first switching valve 82 is switched to allow the water to flow toward the second switching valve 81, and the second switching valve 81 is switched to allow the water to flow toward the ice-making device 30, the purified water may be supplied to the ice-making device.

When the cold water valve 632 is opened, the first switching valve 82 is switched to allow the water to flow toward the second switching valve 81, and the second switching valve 81 is switched to allow the water to flow toward the dispenser 20, the cold water may be dispensed from the dispensing passage 89.

Although the cold water and the hot water are dispensed from the single dispensing passage in the current embodiment, a cold water dispensing passage and a purified water dispensing passage may be separately provided.

The hot water module 70 may be disposed below the dispenser 20. According to the above-described structure, it is possible to efficiently use the narrow inner space of the door.

Figure 3:
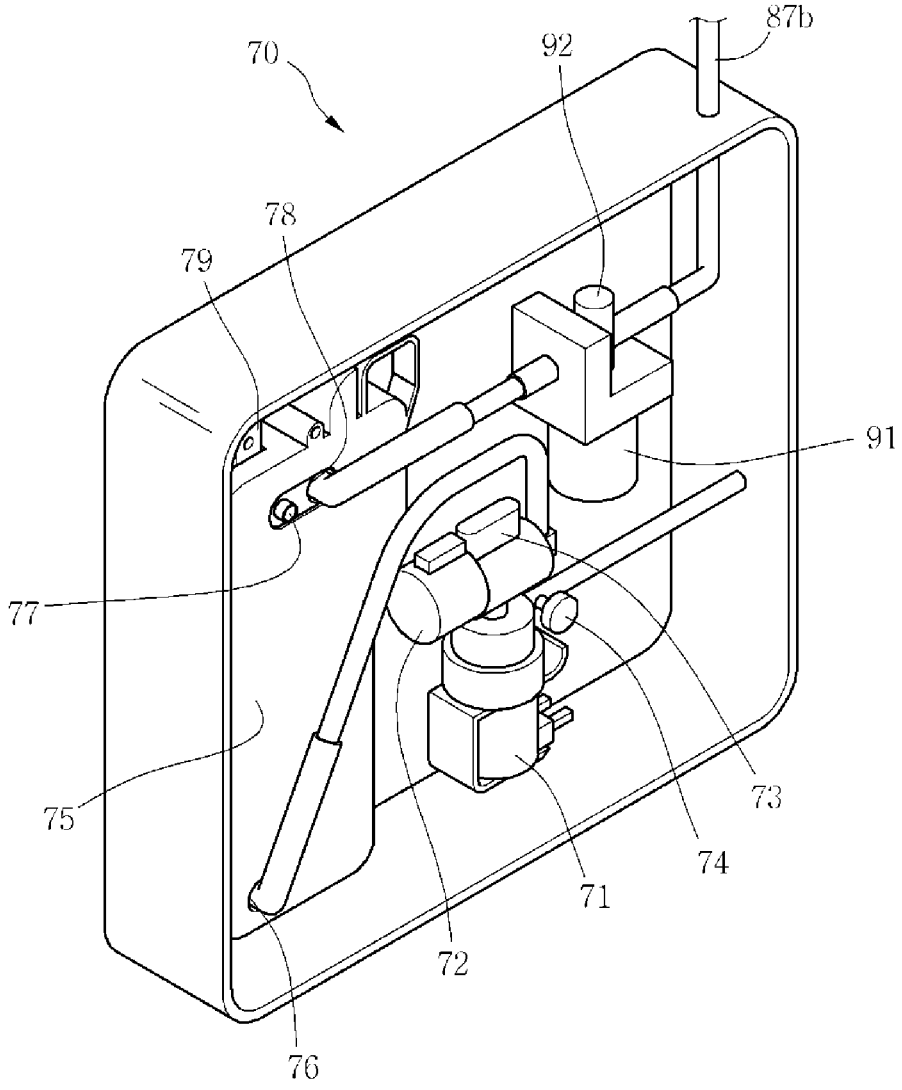
FIG. 3 is a perspective view of a hot water module according to an embodiment.

FIG. 3 is a perspective view of a hot water module according to an embodiment. A hot water module 70 may include an instantaneous heater 75 for heating supplied water.

When there is an instruction to supply hot water, a solenoid 71 is opened to start water supply. An amount of water to be supplied may be controlled by a stepping motor 72. The stepping motor 72 controls an opening degree of a flow control valve 73. The flow control valve 73 may be adjusted in opening degree to regulate a flow rate. For example, the flow control valve 73 may include a fixed plate having an opening and a rotation plate that rotates about the same central axis as the fixed plate and having an opening. An overlapping area between the openings of the fixed and rotation plates may vary in size according to a rotation angle of the rotation plate, thereby determining the amount of water to be supplied. A rotating shaft of the rotation plate may be connected to the stepping motor 72.

A method of controlling a supply amount of water by using the stepping motor 72 will be described in detail. The supply amount of water may be controlled depending upon a temperature of purified water supplied from the outside. The temperature of the purified water may be measured by a water inlet-side temperature sensor 74 installed adjacent to the solenoid 71.

For example, when the purified water has a high temperature as in the summer, even though the flow control valve 73 allows a large amount of purified water to flow therethrough, the instantaneous heater 75 may sufficiently heat the purified water for a short time. On the other hand, when the purified water has a low temperature as in the winter, the flow control valve 73 may allow a small amount of purified water to flow therethrough to sufficiently heat the purified water for a short time by using the instantaneous heater 75. This is done for rapidly supplying hot water having a predetermined temperature.

For example, hot water may be maintained in the temperature range of about 85±5° C. The temperature range is known to be suitable to have coffee and cook a cup noodle. In the embodiment, the supply amount of water is controlled to supply hot water in the predetermined temperature range for a short time. As described above, the objective may be achieved in such a way that the supply amount of water is gradually reduced with decreasing temperature of the purified water.

The supply amount of water has to be controlled to supply the hot water having the predetermined temperature range in a preset period of time; however, the supply amount of water is difficult in determine due to a great effect of an external water pressure. In the embodiment, in view of such a limitation, flow rate information obtained by the water flow sensor 83 is stored when the purified water is dispensed or supplied to the ice-making passage prior to the current purified-water supply. The information may be used as flow rate information for the current purified-water supply.

Water for making ice cubes may be automatically supplied even without a user instruction, and therefore, the flow rate information for the current purified-water supply may be updated to the latest information. When the flow rate measured by the water flow sensor 83 is high, the water pressure is judged as a high pressure, and the flow control valve 73 is closed a little more by the stepping motor. On the other hand, when the flow rate measured by the water flow sensor 83 is low, the water pressure is judged as low pressure, and the flow control valve 73 is opened a little more by the stepping motor.

As described above, the stepping motor may be controlled to more accurately control the supply amount of purified water to the hot water module 70 depending upon the temperature of the purified water. The flow rate information may be more accurately obtained through the consistent update to more accurately control the supply amount of water by using the stepping motor. In consideration of a plurality of variables, the control information of the stepping motor may be stored in the form of a table in a memory.

The method of controlling the stepping motor 72 will be described. When there is an instruction to supply hot water, a temperature of purified water is read from the water inlet-side temperature sensor 74, and the supply amount of water depending upon the current temperature of the purified water is determined with reference to a heating value of the instantaneous heater 75. A supply time of the purified water may be maintained constantly irrespective of the temperature of the purified water. When the supply amount of water is determined, the flow control valve 73 is controlled by reading and referring to the flow rate information of the water flow sensor 83 stored as previous information in the memory, followed by operating the stepping motor 72.

The purified water of which the supply amount is uniformly regulated may be introduced into the instantaneous heater 75 through a water inlet 76 and heated by the instantaneous heater 75. The instantaneous heater 75 may be provided with a heating element having a high heating value, and the purified water may be rapidly heated by the heating element. The amount of water flowing into the instantaneous heater 75 is controlled as described above by controlling the flow control valve 73 using the stepping motor 72 on the basis of the heating value of the instantaneous heater 75, the temperatures of the purified water and discharged water, and the amount of supplied water (i.e., the water supply amount depending upon the water pressure and previously measured by the water flow sensor 83).

The instantaneous heater 75 is provided with a steam exhauster 77 for exhausting steam generated by overheating and instantaneous contact of the heater and water. The instantaneous heater 75 is provided with a thermostat 79. The thermostat 79 turns the instantaneous heater 75 off when the instantaneous heater 75 is overheated to prevent the heater having the high heating value from being damaged. The thermostat may include a bimetal.

The water heated by the instantaneous heater 75 may be discharged through a water outlet 78. The hot water passing through the water outlet 78 may be supplied to the dispenser 20 through the hot water dispensing passage 87*b* while being regulated by a hot water discharging valve 91. The hot water discharging valve 91 is provided with a water outlet-side temperature sensor 92 for measuring a temperature of water within the hot water discharging valve 91. The hot water passing through the hot water discharging valve 91 may be supplied to the dispenser 20, and a user may take the hot water. The water outlet-side temperature sensor 92 may perform two functions as follows.

First, when there is an instruction to supply hot water, a valve-opening time of the hot water discharging valve 91 may be determined depending upon the water temperature measured by the water outlet-side temperature sensor 92. For example, when the water within the hot water discharging valve 91 has a low temperature, it is determined that a predetermined time elapses since the previous hot-water supply. Therefore, the water within the instantaneous heater 75 has to be discharged after sufficiently heated for a long time. On the other hand, when the water within the hot water discharging valve 91 has a high temperature, it is determined that a little time elapses since the previous hot-water supply. Therefore, the water within the instantaneous heater 75 may be discharged after heated for a relatively short time.

In summary, a heating time may vary depending upon the temperature of the water at the water outlet side, that is, a pre-heating time may be adjusted by opening the hot water discharging valve 91 later with decreasing water temperature to accurately control the temperature of hot water taken by a user. Usually, after getting hot water, a user frequently drinks the first cup of hot water for a short time as when having disposable coffee. Even in this case of supplying such a small amount of water, the above-described operation will suffice.

Second, when the water temperature measured by the water outlet-side temperature sensor 92 is beyond a predetermined temperature range, it is determined that the heating element within the instantaneous heater 75 has been overheated, and power supplied to the heating element may need to be interrupted. For example, data is stored in a memory to supply hot water in the temperature range of about 85±5° C., in which case if a temperature of 90° C. or higher is sensed, it is determined that an error state where there is no water has occurred, and power supplied to the heating element may be interrupted to protect the heating element.

Figure 4:
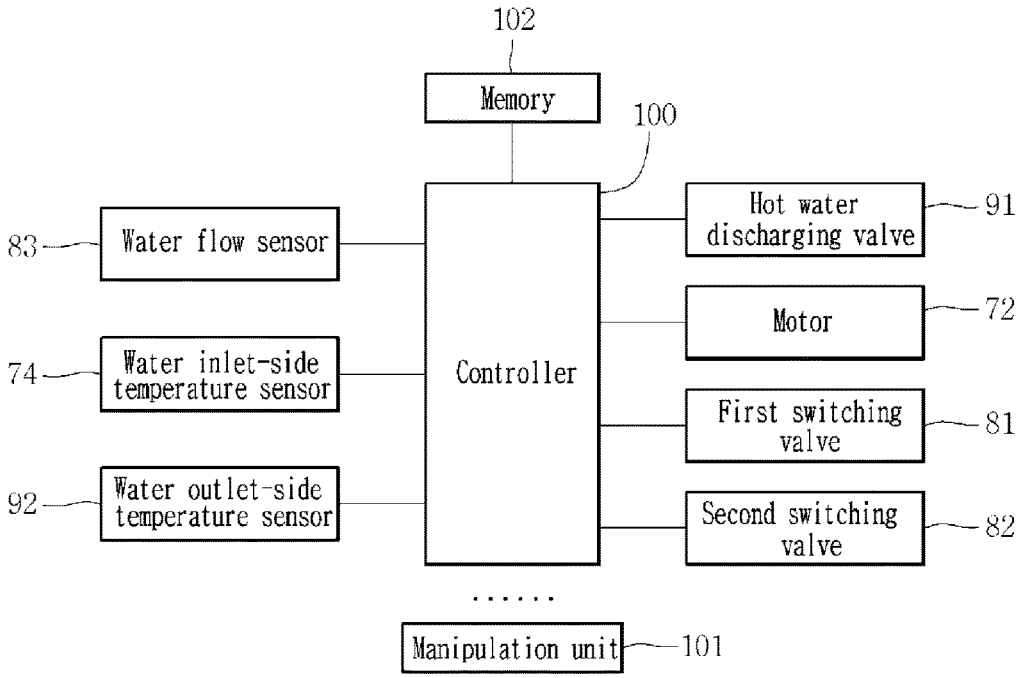
FIG. 4 is a block diagram of a hot water supply system of the refrigerator according to an embodiment.

FIG. 4 is a block diagram of a hot water supply system of the refrigerator according to an embodiment. Descriptions of the hot water supply system of a refrigerator disclosed herein are based on the refrigerator illustrated in FIGS. 1 to 3, and descriptions of the refrigerator may be applied to unexplained configurations as they are. In the refrigerator, the components providing control parameters to a controller 100 and the components controlled by the controller 100 are merely illustrative, and it will be naturally predicted that a refrigerator may include a plurality of components for operations of its own.

Referring to FIG. 4, the hot water supply system includes a water flow sensor 83, a water inlet-side temperature sensor 74, and a water outlet-side temperature sensor 92 as components that provide control parameters to a controller 100. The water flow sensor 83 measures a flow rate of water flowing into a door, the water inlet-side temperature sensor 74 measures a temperature of purified water flowing into a hot water module 70, and the water outlet-side temperature sensor 92 measures a temperature of hot water flowing out of the hot water module 70. The water flow sensor 83 may also measure a flow rate of cold or purified water directly supplied to the ice-making device 30 and the dispenser 20 as well as a flow rate of purified water flowing into the hot water module 70.

The hot water supply system further includes a hot water discharging valve 91, a motor 72, and first and second switching valves 81 and 82 as components that operate according to control signals of the controller 100. The hot water discharging valve 91 regulates discharge of hot water flowing out of the hot water module 70, and the motor 72 controls a water supply amount. The first switching valve 81 may switch a flow direction of water toward the hot water module 70, and the second switching valve 82 may switch a flow direction of water toward the ice-making device 30 or the dispenser 20. The hot water supply system may further include a memory 102 storing various pieces of information required for operations of the controller 100 and a manipulation unit 101 through which a user manipulates an operating state of the refrigerator.

In the hot water supply system of the refrigerator, the water flow sensor 83 measures flow rates of purified water, cold water, and ice-making supply water, which are affected only by a water pressure of a water supply source 1 and supplied without being artificially adjusted in flow rate, and transfers the measured flow rate to the controller 100. The controller 100 stores the flow rate information in the memory 102. The flow rate information may be updated every time water is supplied.

When there is an instruction through the manipulation unit 101 to supply hot water, the water inlet-side temperature sensor 74 senses the temperature of purified water flowing into the hot water module, and the controller 100 determines the amount of water, which may be heated at a predetermined temperature for a predetermined time, with reference to the temperature of the purified water and the information stored in the memory 102.

In order to supply the determined amount of water, the controller 100 operates the motor 72 with reference to the information on the flow rate previously measured by the water flow sensor 83.

Through the above-described process, the amount of purified water continuously supplied to the hot water module 70 may be determined. When the supply amount of purified water is determined the predetermined amount of purified water may be supplied to an instantaneous heater 75 by switching the first switching valve 81 to switch a flow direction of the purified water toward the hot water module 70.

Whether to discharge hot water from the hot water module 70 may be determined by opening or closing the hot water discharging valve 91. In other words, even though there is an instruction to supply hot water, preheating may be performed in view of time required for heat water, and after a predetermined time elapses, the hot water is supplied to the dispenser 20 by opening the hot water discharging valve 91.

Specifically, when there is an instruction to supply hot water, the water outlet-side temperature sensor 92 measures the temperature of water that is most adjacent to the dispenser 20, and a preheating time of the instantaneous heater 75 is determined based on the measured temperature. The hot water discharging valve 91 may not be opened for the preheating time. The preheating time depending upon the information stored in the memory 102 may be determined in consideration of the amount of water existing within a supply passage of hot water and a heating value of the instantaneous heater. According to the above-described configuration, it is possible to further enhance user satisfaction with the temperature of the first cup of hot water to drink.

While the first switching valve 81 is switched to allow water to flow toward the dispenser 20 or the ice-making device 30, the second switching valve 82 may be switched to allow purified water or cold water to flow toward the dispenser 20 or the ice-making device 30. According to the hot water supply system of a refrigerator, it is possible to enhance user satisfaction with the temperature of the first cup of hot water and more accurately control the temperature of hot water.

Figure 5:
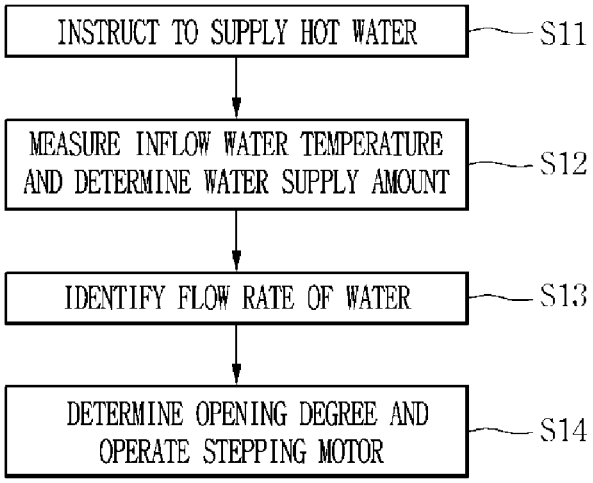
FIG. 5 is a block diagram illustrating a method of supplying hot water in the refrigerator according to an embodiment.

FIG. 5 is a block diagram illustrating a method of supplying the hot water by the refrigerator according to an embodiment. When there is an instruction to supply hot water (S11), the supply amount of water to a hot water module is determined by measuring the temperature of purified water flowing into the hot water module (S12). A flow rate of water flowing through a common passage within a door is identified to supply as much purified water as the determined amount of water to be supplied (S13). Flow rate information measured in the previous supply of purified water, cold water, or water for ice-making may be used as the flow rate. The flow rate information may be information on a flow rate of water introduced into a refrigerator door by a water pressure of a water supply source 1 without being artificially adjusted in inflow rate.

The amount of water supplied to the hot water module is regulated using a flow control valve, while the amount of water to be supplied and a flow rate of water flowing through a dispensing passage or ice-making passage serve as variables. The flow control valve may be controlled by adjusting a rotation angle of a stepping motor.

Figure 6:
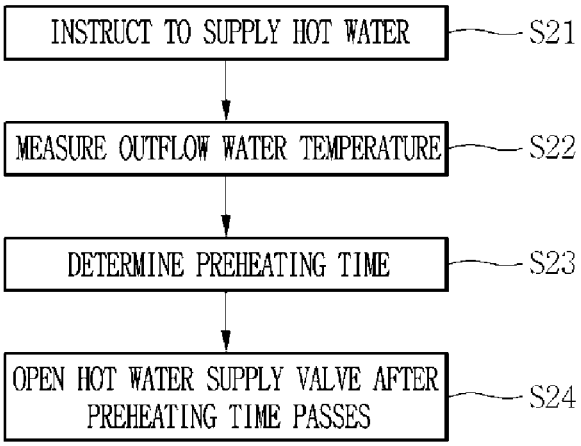
FIG. 6 is a block diagram illustrating a method of supplying hot water in a refrigerator according to another embodiment.

FIG. 6 is a block diagram illustrating a method of supplying hot water by a refrigerator according to another embodiment. When there is an instruction to supply hot water (S21), the temperature of water flowing out of a hot water module 70 is measured (S22), a preheating time is determined (S23), and a hot water discharging valve is opened after the preheating time elapses (S24). The preheating time is a time interval required for heating water stored in the hot water module. The preheating time is aimed at securing a time interval required for reheating water cooled within the hot water module. In addition, an initial temperature of discharged water may be secured by preventing water from being discharged for the preheating time.

The hot water supply methods illustrated in FIGS. 5 and 6 may be applied together or individually. However, application of the two methods is advantageous for securing the temperature of the first cup of hot water and accurately implementing hot water temperature.

In one embodiment, a refrigerator includes: a main body to define a storage space therein; a door that opens and closes the storage space; a water flow sensor to measure a flow rate of water flowing from the main body to the door; a hot water module comprising an instantaneous heater to heat the water introduced into the door; a first switching valve to switch a flow direction of the water passing through the water flow sensor toward the instantaneous heater; a water inlet-side temperature sensor to measure a temperature of the water introduced into the instantaneous heater; a flow control valve to regulate an amount of water supplied to the instantaneous heater; a hot water discharging valve to control discharge of the water heated by the instantaneous heater; and a hot water dispensing passage through which the heated water discharged from the instantaneous heater is dispensed.

In another embodiment, a refrigerator includes: a main body to define a storage space therein; a door that opens and closes the storage space; a water flow sensor to measure a flow rate of water flowing from the main body to the door; a hot water module comprising an instantaneous heater to heat the water introduced into the door; a first switching valve to switch a flow direction of the water passing through the water flow sensor toward the instantaneous heater; a water outlet-side temperature sensor to measure a water outlet-side temperature of the hot water module; a flow control valve to regulate an amount of water supplied to the instantaneous heater; a hot water discharging valve to control discharge of the water heated by the instantaneous heater; a hot water dispensing passage through which the heated water discharged from the instantaneous heater is dispensed; and a controller to control the hot water discharging valve on the basis of the temperature sensed by the water outlet-side temperature sensor.

Terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A refrigerator according to an embodiment may be applied to all types of refrigerators each of which receives water from an external water supply source connected thereto and includes a water supply device and an instantaneous heating device.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body to define a storage space therein;

a door that opens and closes the storage space;

a first water passage provided in the main body through which water from an external water supply source at a first predetermined temperature flows;

a second water passage provided in the main body and including a water tank that receives water from the external water supply source and stores the water at a second predetermined temperature less than the first predetermined temperature;

a first water valve to regulate a water supply through the first water passage;

a second water valve to regulate a water supply through the second water passage;

a common passage provided within the door and connected to the first water passage and the second water passage;

a water flow sensor to measure a flow rate of water provided at the common passage;

a hot water module provided within the door and including an instantaneous heater to heat the water;

a water supply passage provided within the door and having a first end branched from the common passage and a second end connected to the instantaneous heater;

a first switching valve provided within the door to switch a flow direction of the water passing through the water flow sensor toward the instantaneous heater;

an ice making device provided on the door;

an ice-making passage branched from the common passage;

a second switching valve provided within the door to switch a flow direction of the water that passes through the first switching valve;

a dispensing passage connected to the second switching valve to dispense purified water or cold water;

a water inlet-side temperature sensor to measure a temperature of the water introduced into the instantaneous heater;

a flow control valve to regulate an amount of water supplied to the instantaneous heater;

a hot water discharging valve to control discharge of the water heated by the instantaneous heater;

a hot water dispensing passage through which the heated water discharged from the instantaneous heater is dispensed; and a controller to control the flow control valve, wherein the controller regulates the amount of water supplied to the instantaneous heater with reference to a previous flow rate information of the water passing through the water flow sensor and the temperature measured by the water inlet-side temperature sensor, and wherein the previous flow rate information of the water passing through the water flow sensor is stored in a memory, and wherein when the first water valve is opened, and the first switching valve is switched to allow the water to flow toward the hot water module, the water at the first predetermined temperature is supplied to the hot water module, and the heated water is dispensed from the hot water dispensing passage.

2. The refrigerator according to claim 1, wherein the controller controls the flow control valve such that the amount of water supplied to the instantaneous heater is reduced when the temperature measured by the water inlet-side temperature sensor is decreased.

3. The refrigerator according to claim 2, wherein the controller controls the flow control valve such that the flow control valve has an increased degree of opening when a previous flow rate of the water passing through the water flow sensor in the memory is decreased.

4. The refrigerator according to claim 1, further comprising a water outlet-side temperature sensor to measure a temperature of the water flowing out of the hot water module, wherein the controller controls the hot water discharging valve based on the temperature sensed by the water outlet-side temperature sensor.

5. The refrigerator according to claim 4, the controller determines a preheating time depending upon the temperature sensed by the water outlet-side temperature sensor and opens the hot water discharging valve after the preheating time elapses.

6. The refrigerator according to claim 4, wherein the controller stops the operation of the instantaneous heater when the temperature sensed by the water outlet-side temperature sensor is above a predetermined temperature.

7. The refrigerator according to claim 4, wherein the controller controls the hot water discharging valve such that discharge of hot water from the hot water module is delayed with the decreasing temperature measured by the water outlet-side temperature sensor.

8. The refrigerator according to claim 1, wherein the main body comprises:

a cold water passage through which cold water flows; and a purified water passage through which purified water flows, wherein the purified water in the cold water passage and the cold water in the cold water passage flow into the common passage.

9. The refrigerator according to claim 1, wherein a stepping motor is configures to control a flow rate of the water passing through of the flow control valve.

10. The refrigerator according to claim 1, further including a filter provided in the main body that purifies water supplied from the external water source, the filter being provided upstream from the first water passage and the second water passage.

11. The refrigerator according to claim 1, wherein when the first water valve is opened, the second water valve is closed such that only water in the first water passage flows into the common passage.

12. A refrigerator comprising:

a main body to define a storage space therein;

a door that opens and closes the storage space;

a filter provided in the min b that purifies water supplied from an external water supply source;

a purified water passage through which the water purified in the filter flows provided in the main body;

a water tank that receives the water purified in the filter to cool the water therein;

a cold water passage connected to the water tank and provided in the main body;

a purified water valve to regulate a water supply through the purified water passage;

a cold water valve to regulate a water supply through the cold water passage;

a common passage provided within the door and connected to the cold water passage and the purified water passage;

a water flow sensor to measure a flow rate of water provided at the common passage;

a hot water module provided within the door and including an instantaneous heater to heat the water introduced into the door;

a water supply passage provided within the door and having a first end branched from the common passage and a second end connected to the instantaneous heater;

a first switching valve provided within the door to switch a flow direction of the water passing through the water flow sensor toward the instantaneous heater;

an ice making device provided at the door;

an ice-making passage branched from the common passage;

a second switching valve provided within the door to switch a flow direction of the water that passes through the first switching valve;

a dispensing passage connected to the second switching valve to dispense purified water or cold water;

a water inlet-side temperature sensor to measure a temperature of the water introduced into the instantaneous heater;

a water outlet-side temperature sensor to measure a water outlet-side temperature of the hot water module;

a flow control valve to regulate an amount of water supplied to the instantaneous heater;

a hot water discharging valve to control discharge of the water heated by the instantaneous heater;

a hot water dispensing passage through which the heated water discharged from the instantaneous heater is dispensed; and a controller to control the hot water discharging valve on the basis of the temperature sensed by the water outlet-side temperature sensor, wherein the controller regulates the amount of water supplied to the instantaneous heater based on the temperature measured by the water inlet-side temperature sensor, and wherein the controller determines a preheating time depending upon the temperature sensed by the water outlet-side temperature sensor and opens the hot water discharging valve after the preheating time elapses, wherein when the purified water valve is opened, and the first switching valve is switched to allow the water to flow toward the hot water module, the purified water is supplied to the hot water module, and the heated water is dispensed from the hot water dispensing passage.

13. The refrigerator according to claim 12, wherein the controller stops the operation of the instantaneous heater when the temperature sensed by the water outlet-side temperature sensor is above a predetermined temperature.

14. The refrigerator according to claim 12, wherein the controller controls the hot water discharging valve such that discharge of hot water from the hot water module is delayed with the decreasing temperature measured by the water outlet-side temperature sensor.

15. The refrigerator according to claim 12, wherein the controller controls the flow control valve such that the flow control valve has an increasing degree of opening when a previous flow rate of the water passing through the water flow sensor is decreased.

* * * * *